US012435291B2

(12) United States Patent
Michel et al.

(10) Patent No.: US 12,435,291 B2
(45) Date of Patent: Oct. 7, 2025

(54) LUBRICANT COMPOSITION FOR GAS TURBINES

(71) Applicant: TotalEngergies OneTech, Courbevoie (FR)

(72) Inventors: Frédéric Michel, Solaize (FR); Florence Bredon, Solaize (FR)

(73) Assignee: TotalEnergies OneTech, Courbevoie (FR)

( * ) Notice: Subject to any disclaimer, the term of this patent is extended or adjusted under 35 U.S.C. 154(b) by 0 days.

(21) Appl. No.: 17/629,476

(22) PCT Filed: Jul. 24, 2020

(86) PCT No.: PCT/EP2020/070943
§ 371 (c)(1),
(2) Date: Jan. 24, 2022

(87) PCT Pub. No.: WO2021/018768
PCT Pub. Date: Feb. 4, 2021

(65) Prior Publication Data

US 2022/0315856 A1 Oct. 6, 2022

(30) Foreign Application Priority Data

Jul. 26, 2019 (FR) ..... 1908499

(51) Int. Cl.

| | |
|---|---|
| ***C10M 133/12*** | (2006.01) |
| ***C10M 137/02*** | (2006.01) |
| ***C10M 169/04*** | (2006.01) |
| *C10N 30/10* | (2006.01) |
| *C10N 40/00* | (2006.01) |
| *C10N 40/13* | (2006.01) |

(52) U.S. Cl.
CPC ..... *C10M 133/12* (2013.01); *C10M 137/02* (2013.01); *C10M 169/04* (2013.01); *C10M 2215/065* (2013.01); *C10M 2223/049* (2013.01); *C10N 2030/10* (2013.01); *C10N 2040/13* (2013.01); *C10N 2040/135* (2020.05)

(58) Field of Classification Search
CPC ..... C10M 133/12; C10M 137/02; C10M 169/04; C10M 2215/065; C10M 2223/049; C10N 2030/10; C10N 2040/13; C10N 2040/135
See application file for complete search history.

(56) References Cited

U.S. PATENT DOCUMENTS

| | | | | |
|---|---|---|---|---|
| 3,923,672 | A | 12/1975 | Durr, Jr. et al. | |
| 4,064,059 | A * | 12/1977 | Nebzydoski | C10M 3/00 508/437 |
| 4,124,514 | A * | 11/1978 | Yaffe | C10M 135/34 508/301 |
| 4,226,732 | A * | 10/1980 | Reinhard | C10M 169/04 508/444 |
| 4,320,018 | A * | 3/1982 | Yaffe | C10M 129/14 508/439 |
| 6,326,336 | B1 * | 12/2001 | Gatto | C10M 141/08 508/331 |
| 2006/0069000 | A1 * | 3/2006 | Dong | C10M 141/10 508/423 |
| 2010/0009875 | A1 * | 1/2010 | Dong | C10M 141/08 508/561 |
| 2010/0160191 | A1 * | 6/2010 | Butke | C10M 141/08 508/273 |
| 2015/0051126 | A1 * | 2/2015 | Sato | C10M 169/04 508/429 |
| 2017/0183598 | A1 * | 6/2017 | Maruyama | C10M 107/34 |
| 2019/0127526 | A1 * | 5/2019 | Farng | C10M 149/12 |
| 2019/0127656 | A1 * | 5/2019 | Farng | C10M 149/22 |
| 2019/0316056 | A1 * | 10/2019 | Hanthorn | C10M 141/06 |

FOREIGN PATENT DOCUMENTS

| | | | |
|---|---|---|---|
| EP | 3409750 | A1 | 12/2018 |
| WO | 2008/009704 | A1 | 1/2008 |

OTHER PUBLICATIONS

French International Search Report and Written Opinion for counterpart Application No. PCT/EP2020/070943, dated Oct. 27, 2020.

* cited by examiner

*Primary Examiner* — Ellen M McAvoy
(74) *Attorney, Agent, or Firm* — The Marbury Law Group, PLLC

(57) ABSTRACT

The present invention relates to a lubricant composition, in particular for a gas or steam turbine, comprising: —at least one base oil; —at least one phenylnaphthylamine (PAN) compound, preferably alkylphenyl-α-naphthylamine (APAN) compound; —at least one diphenylamine (DPA) compound, preferably dialkyl-diphenylamine compound; and —at least one phosphite ester compound, preferably triaryl phosphite ester compound; in which the ratio by weight between said diphenylamine compound(s) and said phosphite ester compound(s) is strictly greater than 1.0.

8 Claims, No Drawings

LUBRICANT COMPOSITION FOR GAS TURBINES

CROSS REFERENCE TO RELATED APPLICATION

This is a national stage application of PCT/EP2020/070943, filed internationally on Jul. 24, 2020, which claims priority to French Application No. 1908499, filed on Jul. 26, 2019, both of which are incorporated herein, by reference, in their entireties.

TECHNICAL FIELD

The present invention concerns the field of lubricating compositions, more particularly the field of lubricating compositions for turbines. It relates more specifically to a lubricating composition for turbines that employs a combination of three types of specific antioxidant additives, in specific proportions.

PRIOR ART

Gas or steam turbines are typically used in the aircraft, marine, rail transport, and electricity production sectors.

More particularly, gas or steam turbines have advantages of lightness and of high power per unit mass and volume, so making them particularly well-suited to aircraft propulsion, more particularly in aeroplanes and helicopters, but also to marine propulsion, especially for high-speed ships. Furthermore, recent electricity production plants employ gas turbines using high-temperature combustion gases such as liquefied natural gas, or else energy production plants combining a gas turbine and a steam turbine.

Industrial lubricating compositions, also called "lubricating oils" or "lubricants", and more particularly lubricants for gas or steam turbines, may be subject to extreme conditions, and more particularly to temperatures of use that may go beyond 250° C. This is the case, for example, for the lubricating oils for aviation reactor turbines.

Subject to such high-temperature conditions, the lubricating oils may undergo degradation and oxidation. This degradation may be manifested in the formation of deposits, such as coatings, in the presence of sludges and/or in an increase in the viscosity of the composition. The oxidation stability of the lubricating oils is further reduced by the dissolving of metals in these oils, under the extreme conditions of use described above. This is because the dissolved metals are capable of catalyzing the oxidative degradation of the lubricants.

Such degradation greatly reduces the life time of the oils, necessitating a reduction in draining intervals and giving rise to substantial operating losses. At present, some constructors therefore impose very stringent specifications with regard to the oxidation stability and heat stability properties, at high temperature, of the lubricating compositions intended especially for use in gas or steam turbines.

To increase the oxidation stability, the majority of lubricants contain additives intended to inhibit their oxidation. A variety of antioxidant additives have thus been proposed in lubricants, such as, for example, sterically hindered phenol compounds, aromatic organic amines, diphenylamine (DPA) derivatives or else phenylnaphthylamine (PAN) derivatives. As an example, document WO 2008/009704 proposes a lubricating composition, more particularly for turbines, which comprises a succinate ester and a sarcosinic acid as antirust agents. The compositions described therein may further comprise a variety of aromatic amine antioxidants, such as phenyl-α-naphthylamine and dialkyl-α-diphenylamine compounds. However, the lubricating compositions proposed in this document do not attain the required levels of performance in terms of heat stability and oxidation resistance, at high temperature.

Consequently there remains a need for a lubricating composition, more particularly for turbines, which exhibits enhanced properties in terms of heat stability and oxidation resistance while retaining good corrosion resistance properties and enabling a reduction in the formation of unwanted deposits during use of the lubricant, especially in conditions of high temperature.

SUMMARY OF THE INVENTION

The present invention is aimed specifically at meeting this need.

More particularly, according to a first of its aspects, the present invention provides a lubricating composition, more particularly for a gas or steam turbine, comprising:

- at least one base oil;
- at least one phenylnaphthylamine (PAN), preferably alkylphenyl-α-naphthylamine (APAN), compound;
- at least one diphenylamine (DPA), preferably dialkyldiphenylamine, compound; and
- at least one phosphite ester, preferably triaryl phosphite ester, compound;

wherein the ratio by mass between said one or more diphenylamine compounds and said one or more phosphite ester compounds is strictly greater than 1.0.

Counter to expectation, the inventors have found that by employing a combination of the three aforesaid specific antioxidant additives, at least one phenylnaphthylamine (PAN) compound, at least one diphenylamine (DPA) compound and at least one phosphite ester compound, with a DPA compound/phosphite ester compound ratio by mass of strictly greater than 1.0, it is possible to obtain a lubricating composition which has enhanced properties in terms of heat stability, oxidation stability and corrosion resistance, under conditions of high temperature.

More particularly, as illustrated in the examples, it is not possible to attain such performance in terms of heat stability, oxidation stability and corrosion resistance by employing just one or even two out of the three antioxidants contemplated according to the invention.

The specific combination of antioxidant additives according to the invention therefore enables the lubricant to be given excellent properties of reducing phenomena of oxidation and of formation of unwanted deposits that occur during use of the lubricant, especially under conditions of high temperature and in the presence of oxygen.

Advantageously, therefore, a lubricating composition according to the invention exhibits an increased life time.

As detailed in the examples which follow, the corrosion resistance, oxidation stability and heat stability performance can be evaluated according to various tests.

More particularly, a lubricating composition according to the invention advantageously exhibits an oxidation stability as evaluated by the RPVOT (Rotating Pressure Vessel Oxidation Test) according to standard ASTM D2272 of greater than or equal to 2200 minutes, advantageously greater than or equal to 2500 minutes.

Advantageously it has a residual RPVOT as measured according to the "dry TOST—1000 hours" test, adapted from standard ASTM D7873 and detailed below in the examples, of greater than or equal to 70%, advantageously greater than or equal to 75% and more particularly greater than or equal to 80%.

A lubricating composition according to the invention advantageously exhibits an insoluble content after 48 hours at 180° C. of less than 30 mg/kg, preferably less than 25 mg/kg, more preferably less than or equal to 20 mg/kg.

Likewise it exhibits excellent oxidation resistance and corrosion resistance, as evaluated by the ASTM D4636 test.

This enhanced performance in terms of heat stability, oxidation resistance and corrosion resistance makes it possible to reduce the content of or even to do without the presence of ancillary additives, more particularly antiwear and/or extreme pressure additives, or else of pour point depressants (PPD).

The present invention further provides for the use, in a lubricating composition, more particularly for a gas or steam turbine, comprising at least one base oil, of at least one phenylnaphthylamine (PAN), preferably alkylphenyl-α-naphthylamine (APAN) compound; of at least one diphenylamine (DPA), preferably dialkyldiphenylamine, compound; and of at least one phosphite ester, preferably triaryl phosphite ester, compound, said one or more phosphite ester compounds being employed in a DPA/phosphite ester ratio of strictly greater than 1.0, for enhancing the heat stability performance and oxidation resistance performance of the composition.

The lubricating composition according to the invention thus proves particularly suitable for use as a lubricant of a gas or steam turbine.

The present invention, according to another of its aspects, therefore provides for the use of a composition as described above as a lubricant for a gas or steam turbine.

The present invention additionally provides a method for lubricating at least one mechanical component of a system, such as the blades, of a gas or steam turbine, which comprises at least one step of contacting said mechanical component with a lubricating composition according to the invention.

Other features, variants and advantages of the lubricating compositions according to the invention will emerge more clearly from a reading of the description and examples which follow, which are provided for purposes of illustration and which do not limit the invention. In the remainder of the text, the expressions "of between . . . and . . . ", "from . . . to . . . " and "varying from . . . to . . . " are equivalent and are intended to signify that the end points are included, unless otherwise stated.

Absent indication to the contrary, the expression "comprising a(n)" should be understood as "comprising at least one".

DETAILED DESCRIPTION

In the context of the invention, and in the absence of indication to the contrary:

"alkyl" refers to a saturated, linear or branched, aliphatic group; for example, a $C_x$ to $C_z$ alkyl represents a saturated carbon chain of x to z carbon atoms which is linear or branched;

"alkenyl" refers to an unsaturated, linear or branched, aliphatic group; for example, a $C_x$ to $C_z$ alkenyl group represents an unsaturated carbon chain of x to z carbon atoms which is linear or branched;

"cycloalkyl" refers to a cyclic alkyl group; for example, a $C_x$ to $C_z$ cycloalkyl represents a cyclic carbon group of x to z carbon atoms, as for example a cyclopropyl, cyclobutyl, cyclopentyl, cyclohexyl or cycloheptyl;

"aryl" refers to a mono- or polycyclic aromatic group, more particularly comprising between 6 and 10 carbon atoms. Examples of aryl group include phenyl or naphthyl groups.

Phenylnaphthylamine (PAN) Compound

As set out above, according to one of its essential features, a lubricating composition according to the invention comprises at least one phenylnaphthylamine, abbreviated "PAN", compound.

A "phenylnaphthylamine" compound denotes a compound selected from N-phenyl-α-naphthylamine, N-phenyl-β-naphthylamine and derivatives thereof, preferably having one or more alkyl groups as substituents of the phenyl ring.

More particularly, the phenylnaphthylamine, preferably alkylphenyl-α-naphthylamine (abbreviated "APAN"), compound employed according to the invention conforms to the formula (I) below:

(I)

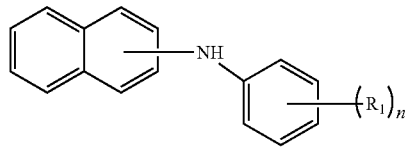

in which:

n is an integer from 1 to 5; and $R_1$ represents a linear or branched alkyl group, preferably a $C_1$ to $C_{22}$ linear or branched alkyl group, more particularly $C_2$ to $C_{12}$.

The phenylnaphthylamine, more particularly alkylphenyl-α-naphthylamine, compound is preferably of formula (I-a) below:

(I-a)

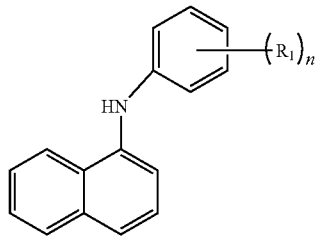

in which $R_1$ and n are as defined above.

The phenylnaphthylamine compound is preferably an alkylphenyl-α-naphthylamine compound, and more particularly conforms to the formula (I-a) above in which n is an integer from 1 to 3, n more particularly being 1.

According to one particular embodiment, the phenylnaphthylamine compound is of formula (I-b) below:

(I-b)

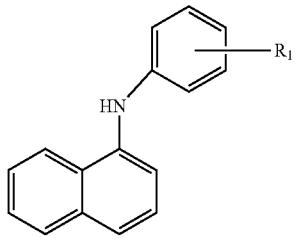

in which $R_1$ is as defined above, $R_1$ preferably representing a $C_2$ to $C_{12}$ alkyl group.

The group $R_1$ is preferably positioned para to the amine group.

The phenylnaphthylamine compounds may be available commercially or prepared by synthesis methods known to the skilled person.

A lubricating composition according to the invention preferably comprises between 0.05% and 5% by mass of phenylnaphthylamine compound or compounds, more particularly between 0.1% and 3% by mass, preferably between 0.15% and 1% by mass, and more particularly between 0.2% and 0.5% by mass, of phenylnaphthylamine compound or compounds, relative to the total mass of the composition.

Diphenylamine (DPA) Compound

As indicated above, a lubricating composition according to the invention further comprises at least one diphenylamine (abbreviated DPA) compound.

A "diphenylamine compound" denotes diphenylamine and derivatives thereof, preferably in which at least one or even both phenyl groups are substituted by one or more groups selected from linear or branched alkyl groups.

The diphenylamine, preferably dialkyldiphenylamine, compound employed according to the invention conforms more particularly to the formula (II) below:

(II)

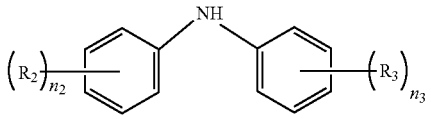

in which:

$n_2$ and $n_3$ independently of one another are integers from 1 to 5; and $R_2$ and $R_3$ independently of one another represent a preferably $C_1$ to $C_{22}$, more particularly $C_4$ to $C_8$, linear or branched alkyl group.

The diphenylamine, preferably dialkyldiphenylamine, compound employed according to the invention is preferably of formula (II-a) below:

(II-a)

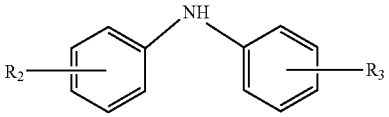

in which $R_2$ and $R_3$ are as defined above.

The groups $R_2$ and $R_3$ are preferably positioned para to the amino group.

Accordingly, in one particular embodiment, the diphenylamine compound is selected from p,p'-dialkyldiphenylamine compounds.

The diphenylamine compounds may be available commercially or prepared by synthesis methods known to the skilled person.

A lubricating composition according to the invention comprises preferably between 0.05% and 5% by mass of diphenylamine compound or compounds, more particularly between 0.1% and 3% by mass, preferably between 0.15% and 1% by mass and more particularly between 0.2% and 0.5% by mass, of diphenylamine compound or compounds, relative to the total mass of the composition.

According to one particularly preferred embodiment, said phenylnaphthylamine compound or compounds are selected from the compounds of formula (I-b) above, more particularly in which $R_1$ represents a $C_2$ to $C_{12}$ alkyl group; and said diphenylamine compound or compounds are selected from the compounds of formula (II-a) above, more particularly in which $R_2$ and $R_3$ independently of one another represent a preferably $C_2$ to $C_{12}$ linear or branched alkyl group.

According to one particular embodiment, said phenylnaphthylamine (PAN) compound or compounds, more particularly as defined above, and said diphenylamine (DPA) compound or compounds, more particularly as defined above, are employed in an N-phenyl-α-naphthylamine compound/diphenylamine compound ratio by mass of between 0.8 and 1.0, more particularly of about 1.

Phosphite Ester

As indicated above, a lubricating composition according to the invention further comprises at least one phosphite ester compound.

The phosphite ester compounds may more particularly be of formula (III) below:

(III)

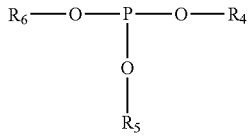

in which each $R_4$, $R_5$ and $R_6$ independently of one another represents a hydrocarbon group having preferably from 1 to 24 carbon atoms.

The hydrocarbon groups in the formula (III) above may more particularly be selected independently of one another from:

preferably $C_2$ to $C_{18}$ linear or branched alkenyl groups;

preferably $C_1$ to $C_{24}$ alkoxyalkyl groups;

preferably $C_3$ to $C_8$ cycloalkyl groups;

preferably $C_6$ to $C_{10}$ aryl groups;

said groups may themselves be optionally substituted by one or more hydrocarbon groups, more particularly by one or more alkenyl, alkoxyalkyl, cycloalkyl and/or aryl groups.

$R_4$, $R_5$ and $R_6$ are preferably selected independently of one another from preferably $C_3$ to $C_8$ cycloalkyl groups and preferably $C_6$ to $C_{10}$ aryl groups, it being possible for said cycloalkyl and aryl groups to be optionally substituted by one or more linear or branched alkyl groups. According to one particular embodiment, the phosphite ester compound employed according to the invention is of formula (III) above in which $R_4$, $R_5$ and $R_6$ are identical, preferably as defined above.

According to this embodiment, the phosphite ester compounds according to the invention may advantageously be selected from triaryl phosphite esters, and especially tri (alkyl-aryl) phosphite esters, preferably from triphenyl phosphite esters and more particularly from tri(alkyl-phenyl) phosphite esters.

A phosphite ester compound according to the invention preferably conforms to the formula (III-a) below:

(III-a)

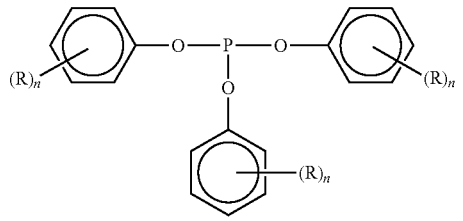

in which the groups R independently of one another represent $C_1$ to $C_{10}$, more particularly $C_3$ to $C_8$, linear or branched alkyl groups and n independently at each occurrence represents 0, 1 or 2, more particularly 1 or 2.

Preferably n is 1 or 2, and preferably n is 2.

Preferably n is 2 and the groups R represent groups in particular in ortho and para positions, preferably $C_3$ to $C_6$, preferably branched, alkyl groups, such as a tert-butyl group.

A phosphite ester compound according to the invention is preferably of formula (III-a) in which the groups —$(R)_n$ are identical.

A phosphite ester compound according to the invention is advantageously tris(2,4-ditert-butylphenyl) phosphite (CAS 31570-04-4).

According to one particular embodiment, the compound in question is tris(2,4-ditert-butylphenyl) phosphite (CAS 31570-04-4).

The phosphite ester compounds may be available commercially or prepared by synthesis methods known to the skilled person.

A lubricating composition according to the invention comprises preferably between 0.01% and 3% by mass of phosphite ester compound or compounds, more particularly between 0.02% and 1% by mass, preferably between 0.05% and 0.5% by mass and more particularly between 0.1% and 0.3% by mass, of phosphite ester compound or compounds, relative to the total mass of the composition.

According to one particular embodiment, said one or more diphenylamine compounds are selected from the compounds of formula (II-a) above, more particularly in which $R_2$ and $R_3$ independently of one another represent a preferably $C_2$ to $C_{12}$, linear or branched alkyl group, and said one or more phosphite ester compounds are selected from the compounds of formula (III-a) above, more particularly in which n is 2 and the groups R represent groups especially in ortho and para positions, preferably $C_3$ to $C_6$, preferably branched, alkyl groups, such as a tert-butyl group.

As indicated above, said one or more diphenylamine (DPA) compounds, more particularly as defined above, and said one or more phosphite ester compounds, more particularly as defined above, are employed in a DPA compound/phosphite ester compound ratio by mass of strictly greater than 1.0, more particularly greater than or equal to 1.5, especially greater than or equal to 2.0 and very particularly between 2.0 and 3.0.

Said one or more phenylnaphthylamine (PAN) compounds, more particularly as defined above, and said one or more phosphite ester compounds, more particularly as defined above, are advantageously employed in a PAN compound/phosphite ester compound ratio by mass of strictly greater than 1.0, more particularly greater than or equal to 1.5, especially strictly greater than 2.0 and very particularly between 2.1 and 3.0.

It is appreciated that combination is possible between the different aforesaid embodiments, especially with regard to the nature of said one or more phenylnaphthylamine compounds, said one or more diphenylamine compounds and said one or more phosphite ester compounds.

More particularly, a lubricating composition according to the invention advantageously comprises at least the combination:

- of one or more phenylnaphthylamine, more particularly alkylphenyl-α-naphthylamine, compounds, as defined above, preferably selected from the compounds of formula (I-b) above in which $R_1$ preferably represents a $C_2$ to $C_{12}$ alkyl group;
- of one or more diphenylamine, more particularly dialkyldiphenylamine, compounds, as defined above, preferably selected from the compounds of formula (II-a) above in which $R_2$ and $R_3$ independently of one another preferably represent a preferably $C_2$ to $C_{12}$, linear or branched alkyl group; and
- of one or more phosphite ester, more particularly triaryl phosphite ester, compounds, as defined above, preferably selected from the compounds of formula (III-a) above, more particularly in which n is 2 and the groups R represent groups especially in ortho and para positions, preferably $C_3$ to $C_6$, preferably branched, alkyl groups, such as a tert-butyl group; where said one or more diphenylamine compounds and said one or more phosphite ester compounds are employed in a diphenylamine compound/phosphite ester compound ratio by mass of strictly greater than 1.0.

According to one particular embodiment, a lubricating composition according to the invention comprises:

- from 0.05% to 5% by mass, more particularly from 0.1% to 3% by mass, preferably from 0.15% to 1% by mass, and very particularly from 0.2% to 0.5% by mass, of one or more phenylnaphthylamine, preferably alkylphenyl-α-naphthylamine, compounds, more particularly as defined above, preferably selected from the compounds of formula (I-a) above in which $R_1$ preferably represents a $C_2$ to $C_{12}$ alkyl group;
- from 0.05% to 5% by mass, more particularly from 0.1% to 3% by mass, preferably from 0.15% to 1% by mass, and very particularly from 0.2% to 0.5% by mass, of one or more diphenylamine, preferably dialkyldiphenylamine, compounds, more particularly as defined above, preferably selected from the compounds of formula (II-a) above in which $R_2$ and $R_3$ independently of one another preferably represent a preferably $C_2$ to $C_{12}$, linear or branched alkyl group; and
- from 0.01% to 3% by mass, more particularly from 0.02% to 1% by mass, preferably from 0.05% to 0.5% by mass, and very particularly from 0.1% to 0.3% by mass, of one or more phosphite ester, preferably triaryl phosphite ester, compounds, more particularly as defined above, preferably selected from the compounds of formula (III-a) above, more particularly in which n is 2 and the groups R represent groups especially in ortho and para positions, preferably $C_3$ to $C_6$, preferably branched, alkyl groups, such as a tert-butyl group;

the amounts being expressed relative to the total mass of said lubricating composition, with the proviso that the diphenylamine compound/phosphite ester compound ratio by mass is strictly greater than 1.0.

Base Oil or Oils

As indicated above, a lubricating composition according to the invention comprises at least one base oil.

Said one or more base oils present in a lubricating composition according to the invention are selected appropriately, particularly with regard to their compatibility with the phenylnaphthylamine, diphenylamine and phosphite ester compounds employed according to the invention.

The base oil may comprise a mixture of two or more base oils—for example, a mixture of two, three or four base oils.

These base oils may be selected from base oils which are conventionally used in the field of lubricating oils, such as mineral, synthetic or natural, animal or plant oils or mixtures thereof. The base oils used in the lubricating compositions according to the invention may more particularly be oils of mineral or synthetic origin that belong to groups I to V according to the classes defined in the API classification (table 1) or equivalents thereof according to the ATIEL classification, or mixtures thereof.

TABLE 1

| | Content of saturates | Sulfur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI ≤ 120 |
| Group III Hydrocracked or hydroisornerized oils | ≥90% | ≤0.03% | ≥120 |
| Group IV | Polyalphaolefins (PAO) | | |
| Group V | Esters and other bases not included in groups I to IV | | |

The mineral base oils include all types of bases obtained by atmospheric and vacuum distillation of crude oil, followed by refining operations such as solvent extraction, deasphalting, solvent deparaffining, hydrotreating, hydrocracking, hydroisomerization and hydrofinishing.

The synthetic base oils may be esters of carboxylic acids and alcohols, polyalphaolefins (PAO) or else polyalkylene glycols (PAG) obtained by polymerizing or copolymerizing alkylene oxides comprising from 2 to 8 carbon atoms, more particularly from 2 to 4 carbon atoms. The polyalphaolefins used as base oils are, for example, obtained from monomers comprising 4 to 32 carbon atoms, as for example from decene, octene or dodecene, having a viscosity at 100° C. of between 1.5 and 15 $mm^2 \cdot s^{-1}$ according to standard ASTM D445. Their average molecular mass is generally between 250 and 3000 according to standard ASTM D5296.

Mixtures of synthetic and mineral oils may also be employed.

There is generally no limitation as regards the use of different lubricating bases for producing the lubricating compositions according to the invention, apart from the fact that they must have properties—especially in terms of viscosity, viscosity index, sulfur content and anticorrosion—that are suitable for use for gas and/or steam turbines.

The base oil is preferably selected from group II and III oils of the API classification, and mixtures thereof. The group II and III base oils make it possible, advantageously, to improve further the oxidation stability properties of the lubricating composition.

The base oil is preferably selected from group III oils.

The kinematic viscosity, measured at 40° C. according to standard ASTM D445, of the base oil or mixture of base oils may advantageously be between 20 $mm^2/s$ and 100 $mm^2/s$, preferably between 25 $mm^2/s$ and 50 $mm^2/s$.

A lubricating composition according to the invention advantageously comprises at least 40% by mass of base oil or oils relative to the total mass of the composition, more particularly at least 50% by mass of base oil or oils, and especially between 60% and 99.5% by mass and very particularly between 70% and 99% by mass, of base oil or oils.

Additional Additives

A lubricating composition according to the invention may further comprise additional additives that are suitable for use in a lubricant for turbines, such as gas and/or steam turbines.

A lubricating composition according to the invention advantageously comprises one or more additives selected from antioxidants other than the compounds employed in the context of the present invention, viscosity index (VI) improvers, pour point depressants (PPD), antifoams, thickeners, corrosion inhibitors, copper passivators, and mixtures thereof.

It will be appreciated that the nature and the amount of additives employed are selected so as not to adversely affect the properties of the lubricating composition, more particularly the above-discussed performance properties imparted by the combination of the three antioxidants employed according to the invention.

A lubricating composition according to the invention may further comprise one or more corrosion inhibitors.

Corrosion inhibitors are known to the person skilled in the field of lubricants, especially of lubricants for turbines.

They may more particularly be selected from organic-acid esters, triazole derivatives, N-acyl sarcosines or else imidazoline derivatives.

According to one particular embodiment, a lubricating composition according to the invention comprises one or more corrosion inhibitors selected from triazole derivatives and organic-acid esters, more particularly alkylated organic-acid esters.

The triazole compound is preferably a benzotriazole or a derivative thereof, preferably a benzotriazole derivative, more preferably a tolyltriazole derivative.

The tolyltriazole derivatives may more particularly be of formula (IV) below:

(IV)

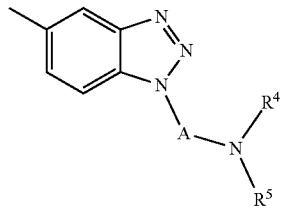

in which:

$R^4$ and $R^5$ independently of one another represent a hydrogen atom or a $C_3$ to $C_{14}$, preferably $C_6$ to $C_{12}$, linear or branched, preferably branched, alkyl group; and -A- represents a $C_1$ to $C_6$, preferably $C_1$ to $C_3$, linear or branched, preferably linear, alkylene group, and more preferably a methylene group (—$CH_2$—), said tolyltriazole derivative being more particularly 2-ethyl-N-(2-ethylhexyl)-N-[(4-methylbenzotriazol-1-yl) methyl]hexan-1-amine.

According to one particular embodiment, the triazole compound is of formula (IV) in which $R^4$ and $R^5$ represent $C_6$ to $C_{12}$ branched alkyl groups and -A- represents a $C_1$ to $C_3$ alkylene group, preferably methylene group.

Examples of alkylated organic-acid ester corrosion inhibitors include esters of succinic acid.

The one or more corrosion inhibitor additives, more particularly tolyltriazole derivative and/or alkylated organic-acid ester corrosion inhibitors, may be employed in a lubricating composition according to the invention at from 0.01% to 5% by mass, more particularly from 0.1% to 3% by mass and very particularly from 0.1% to 2% by mass, relative to the total mass of the lubricating composition.

A lubricating composition according to the invention may further comprise at least one antifoam. The antifoams may be selected, for example, from polar polymers such as polymethylsiloxanes or polyacrylates. More particularly a lubricating composition according to the invention may comprise from 0.01% to 3% by mass of antifoam or antifoams, relative to the total weight of the lubricating composition.

A lubricating composition according to the invention may additionally comprise one or more antioxidant additives, different from the above-described phenylnaphthylamine, diphenylamine and phosphite ester compounds.

Examples of additional antioxidant additives include, for example, sterically hindered phenols, sterically hindered phenol esters and sterically hindered phenols comprising a thioether bridge. The sterically hindered phenols are preferably selected from compounds comprising a phenol group in which at least one carbon vicinal to the carbon bearing the alcohol function is substituted by at least one $C_1$-$C_{10}$ alkyl group, preferably a $C_1$-$C_6$ alkyl group, preferably a $C_4$ alkyl group, preferably by the tert-butyl group. Examples of sterically hindered phenol and deoxidant additives include 2,6-di-t-butyl-4-methylphenol (BHT), t-butylhydroquinone (TBHQ), 2,6- and 2,4-di-t-butylphenol, 2,4-dimethyl-6-t-butylphenol, pyrogallol, and octyl 3,5-di-tert-butyl-4-hydoxyhydrocinnamate.

According to one particular embodiment, a lubricating composition according to the invention does not comprise any antioxidant additive other than the above-described phenylnaphthylamine, diphenylamine and phosphite ester compounds.

A lubricating composition according to the invention may also comprise at least one pour point depressant (PPD). By slowing down the formation of paraffin crystals, pour point depressants generally enhance the low-temperature behavior of the lubricating composition according to the invention. Examples of pour point reducing agents include polyalkyl methacrylates, polyacrylates, polyarylamides, polyalkylphenols, polyalkylnaphthalenes and alkylated polystyrenes.

A lubricating composition according to the invention may comprise from 0.1% to 2%, preferably from 0.2% to 1% by mass of pour point depressant or depressants, relative to the total weight of the composition.

According to one particular embodiment, a lubricating composition according to the invention comprises less than 200 ppm, more particularly less than 100 ppm, especially less than 50 ppm and very particularly less than 10 ppm by mass of, or is even entirely free from, pour point depressant or depressants.

A lubricating composition according to the invention may also comprise at least one viscosity index (VI) improver additive. Viscosity index improvers, more particularly viscosity index improver polymers, ensure good low-temperature stability and a minimal viscosity at high temperature. Examples of viscosity index improver polymers include polymeric esters, hydrogenated or unhydrogenated homopolymers or copolymers of styrene, butadiene and isoprene, olefin homopolymers or copolymers, such as those of ethylene or propylene, and polyacrylates and polymethacrylates (PMA), preferably olefin homopolymers or copolymers, such as those of ethylene or propylene.

A lubricating composition according to the invention may more particularly comprise from 1% to 15% by mass of viscosity index improver additive or additives, preferably from 5% to 10% by mass, relative to the total weight of the lubricating composition.

A lubricating composition according to the invention advantageously comprises an amount by mass of less than or equal to 200 ppm, more particularly less than or equal to 100 ppm, especially less than or equal to 50 ppm and very particularly less than or equal to 10 ppm of, or is even entirely free from, phosphate ester antiwear and/or extreme pressure additives, such as tri(isopropylphenyl) phosphate.

A lubricating composition according to the invention advantageously comprises an amount by mass of less than or equal to 200 ppm, more particularly less than or equal to 100 ppm, especially less than or equal to 50 ppm and very particularly less than or equal to 10 ppm of, or is even entirely free from, amine phosphate salt antiwear and/or extreme pressure additives.

A lubricating composition according to the invention more preferably comprises less than 200 ppm, more particularly less than 100 ppm, especially less than 50 ppm and very particularly less than 10 ppm by mass of, or is even entirely free from, phosphorus antiwear and/or extreme pressure additives containing sulfur or zinc.

The inventors have observed, in fact, that the presence of such phosphorus compounds containing sulfur or zinc is liable to induce unwanted formation of deposits when the lubricating composition is used for turbines.

A lubricating composition according to the invention more preferably comprises less than 200 ppm, more particularly less than 100 ppm, especially less than 50 ppm and very particularly less than 10 ppm by mass of, or is even entirely free from, phosphorus and/or sulfur antiwear and/or extreme pressure additives.

As regards formulation of a lubricating composition according to the invention, the antioxidants contemplated according to the invention, phenylnaphthylamine, diphenylamine and phosphite ester compounds as described above may be added to a base oil or mixture of base oils, after which the other, complementary additives are added.

The antioxidants contemplated according to the invention, phenylnaphthylamine, diphenylamine and phosphite ester compounds may alternatively be added to a pre-existing lubricating formulation comprising, in particular, one or more base oils and optionally additional additives.

The antioxidants contemplated according to the invention, phenylnaphthylamine, diphenylamine and phosphite ester compounds may be combined with one or more complementary additives and the additive "package" thus formed is added to a base oil or mixture of base oils.

By employing the three antioxidant compounds according to the invention, N-phenylnaphthylamine compound or compounds, diphenylamine compound or compounds and phosphite ester compound or compounds, it is possible to do without the use of antiwear and/or extreme pressure additives.

Therefore, according to one particular embodiment, a lubricating composition according to the invention comprises less than 200 ppm, more particularly less than 100 ppm, especially less than 50 ppm and very particularly less than 10 ppm by mass of, or is even entirely free from, antiwear and/or extreme pressure additives.

According to one particularly preferred embodiment, a lubricating composition according to the invention comprises or even consists of:

- a base oil or mixture of base oils preferably selected from group II and III, preferably group III, base oils;
- one or more phenylnaphthylamine (PAN), more particularly alkylphenyl-α-naphthylamine, compounds, as defined above, preferably selected from the compounds of formula (I-a) above in which $R_1$ represents preferably a $C_2$ to $C_{12}$ alkyl group;
- one or more diphenylamine (DPA), more particularly dialkyldiphenylamine, compounds, as defined above, preferably selected from the compounds of formula (II-a) above in which $R_2$ and $R_3$ preferably represent independently of one another a preferably $C_2$ to $C_{12}$ linear or branched alkyl group;
- one or more phosphite ester, more particularly triaryl phosphite ester, compounds, as defined above, preferably selected from the compounds of formula (III-a) above, more particularly in which n is 2 and the groups R represent groups, especially in ortho and para positions, preferably $C_3$ to $C_6$, preferably branched alkyl groups, such as a tert-butyl group; where the DPA compound/phosphite ester compound ratio by mass is strictly greater than 1; and
- optionally one or more complementary additives, selected preferably from corrosion inhibitor additives, more particularly from tolyltriazole derivatives, and alkylated organic-acid esters; and antifoams.

A lubricating composition according to the invention may more particularly comprise or even consist of:

- from 50% to 99.5% by weight, preferably from 70% to 99% by weight, of base oil or oils, preferably selected from group II and III, preferably group III, base oils;
- from 0.05% to 5% by mass, more particularly from 0.1% to 3% by mass, preferably from 0.15% to 1% by mass and very particularly from 0.2% to 0.5% by mass of one or more phenylnaphthylamine, more particularly alkylphenyl-α-naphthylamine, compounds, as defined above, preferably selected from the compounds of formula (I-a) above in which $R_1$ represents preferably a $C_2$ to $C_{12}$ alkyl group;
- from 0.05% to 5% by mass, more particularly from 0.1% to 3% by mass, preferably from 0.15% to 1% by mass and very particularly from 0.2% to 0.5% by mass of one or more diphenylamine, more particularly dialkyldiphenylamine, compounds, as defined above, preferably selected from the compounds of formula (II-a) above in which $R_2$ and $R_3$ independently of one another preferably represent a preferably $C_2$ to $C_{12}$ linear or branched alkyl group; and
- from 0.01% to 3% by mass, more particularly from 0.02% to 1% by mass, preferably from 0.05% to 0.5% by mass and very particularly from 0.1% to 0.3% by mass of one or more phosphite ester, more particularly triaryl phosphite ester, compounds, as defined above, preferably selected from the compounds of formula (III-a) above, more particularly in which n is 2, and the groups R represent groups, especially in ortho and para positions, preferably $C_3$ to $C_6$, preferably branched, alkyl groups, such as a tert-butyl group;
- optionally from 0.01% to 5% by mass, more particularly from 0.1% to 3% by mass and very particularly from 0.1% to 2% by mass of corrosion inhibitor additive or additives, more particularly of tolyltriazole derivative and/or alkylated organic-acid ester type; and
- optionally from 0.01% to 3% by weight of antifoam additives, with the proviso that the diphenylamine compound/phosphite ester compound ratio by mass is strictly greater than 1.0, the amounts being expressed relative to the total mass of said lubricating composition.

A lubricating composition according to the invention may have a kinematic viscosity, measured at 40° C. according to standard ISO 3104, of between 20 $mm^2/s$ and 100 $mm^2/s$, more particularly between 25 $mm^2/s$ and 50 $mm^2/s$.

A lubricating composition according to the invention advantageously has a viscosity index, measured according to standard ASTM D2270-93, of between 100 and 300, more particularly between 100 and 150.

It has more particularly an acid index, measured according to standard ASTM D664, of between 0.08 and 0.2.

As set out above, a lubricating composition according to the invention has excellent properties in terms of oxidation stability, heat stability and corrosion resistance.

A lubricating composition according to the invention thus advantageously has an increased life time.

More particularly, a lubricating composition according to the invention advantageously has an RPVOT oxidation stability as measured according to standard ASTM D2272 of greater than equal to 2200 minutes, advantageously greater than or equal to 2500 minutes.

Such a composition advantageously has a residual RPVOT, measured according to the "dry TOST—1000 hours" test by a method adapted from standard ASTM D7873, of greater than or equal to 70%, advantageously greater than or equal to 75% and very particularly greater than or equal to 80%.

A lubricating composition according to the invention advantageously has an insoluble content after 48 hours at 180° C. of less than 30 mg/kg, preferably less than 25 mg/kg, more preferably less than or equal to 20 mg/kg.

It also has an excellent resistance to oxidation and corrosion, as evaluated according to the ASTM D4636 test.

The invention will now be described using the following examples, which are given for illustrative purposes and do not limit the invention.

Example

Measurement Protocols

Evaluation of Corrosion Resistance

The corrosion resistance may be quantified by measuring the corrosion of steel in the presence of salt water after 24 hours at 60° C., according to standard ISO 7120B.

The purpose of this method is to verify the capacity of compositions to protect against corrosion of ferrous metals in the presence of water. It involves stirring a mixture of 300 ml of test oil with 30 ml of synthetic salt water at a temperature of 60±1° C. in the presence of a cylindrical steel test specimen immersed in the oil. After contact with the oil-water mixture, the test specimen is examined to verify the presence or absence of rust. The test lasts generally 24 hours.

Evaluation of Oxidation Resistance—RPVOT (ASTM D2272)

A first method for measuring the oxidation stability of a composition is the RPVOT (Rotating Pressure Vessel Oxidation Test), performed according to standard ASTM D2272. This method involves placing a 50 g sample of oil in a rotating chamber under oxygen pressure in the presence of water and of a copper catalyst, to evaluate its oxidation resistance. The conditions are as follows:

temperature: 150° C.;

oxygen pressure: 620 kPa;

rotation speed: 100 revolutions per minute;

rotation angle: 30°.

The result expresses the life time of the test oil, expressed in minutes.

The greater the life time of the oil thus determined, the greater its oxidation resistance.

Evaluation of Oxidation Resistance—Residual RPVOT According to the "Dry TOST—1000 Hours" Test (Adapted from Standard ASTM D7873)

A second method for measuring the oxidation stability of a composition involves evaluating the residual RPVOT after artificial aging of the oil in accordance with the dry Turbine Oxidative Stability Test, referred to as "dry TOST—1000 hours" and adapted from standard ASTM D7873, to be carried out over a duration of 1000 hours.

This method involves heating a tube containing 360 mL of oil sample to 120° C. under oxygen and in the presence of an Fe/Cu catalyst for a total duration of 1000 hours.

The tube is subsequently removed for analysis by measurement of the RPVOT (ASTM D2272 method described above).

The residual RPVOT is calculated by dividing the RPVOT value of the oil having undergone the dry TOST—1000 hours aging by the same value for the "virgin" oil, in other words an oil not having undergone any aging, and determined according to the first method defined above.

The higher the residual RPVOT, the greater the oxidation resistance of the oil.

Oxidation Stability and Corrosion Stability at High Temperature (ASTM D4636—Procedure 25 and Non-Standardized Test)

This method for measuring oxidation and corrosion is applied more particularly to hydraulic oils, to aviation turbine oils and more generally to oils which are subject to high temperatures.

There is a standardized method allowing measurement of the oxidation and corrosion of lubricating compositions according to standard ASTM D4636—procedure 25.

The method involves oxidizing a volume of 100 mL of oil at 175° C. for 72 hours in the presence of an airflow of 5 L/h and of specimens of copper, steel, aluminum, magnesium and cadmium metals.

The following parameters are evaluated between the start and end of the test:

the variation in kinematic viscosity at 40° C., the loss of mass of the cadmium specimen, and the loss of mass of the magnesium specimen.

The lower the variations thus evaluated, the better the performance of the oil with respect to oxidation and corrosion.

The applicant has also developed a method enabling quantification of the oxidation and corrosion of lubricating compositions at high temperature.

This non-standardized method involves oxidizing a volume of 40 mL of oil at 175° C. for 24 h in the presence of an airstream of 5 L/h and of specimens of copper and cadmium metals. The variation in kinematic viscosity at 40° C. is evaluated between the start and the end of the test.

Heat Stability

The heat stability of an oil may be evaluated by measuring the insoluble content after 48 hours at 180° C.

The insoluble mass in an oil is determined gravimetrically by filtering a 100 g sample on a membrane filter having pore size of 0.45 μm.

The higher the insoluble content, the less the heat stability of the oil.

Example 1

Preparation of Lubricating Compositions

A lubricating composition in accordance with the invention (I1), comprising a combination of additives required according to the invention, namely an alkylphenyl-α-naphthylamine, an alkyldiphenylamine and a phosphite ester, with an alkyldiphenylamine/phosphite ester ratio of strictly greater than 1.0, and comparative compositions (C1 to C4), not containing a specific combination of this kind, were formulated.

The lubricant compositions were prepared by simple mixing at ambient temperature of the following components in the proportion by mass indicated in tables 2 and 3 below.

TABLE 2

| | Invention | Comparative | | | |
|---|---|---|---|---|---|
| | I1 | C11 | C2 | C3 | C4 |
| Base oil (group III) | 98.98 | 99.13 | 99.48 | 99.3 | 99.38 |
| Alkylphenyinaplithylamine | 0.35 | — | 0.2 | 0.2 | 0.35 |
| Octyl/butyldiphenylamine | 0.35 | 0.35 | 0.7 | 0.1 | — |
| Tris(di-t-butylphenyl) phosphite | 0.15 | 0.35 | — | 0.1 | — |
| Succinate ester | 0.05 | 0.05 | 0.05 | 0.05 | 0.15 |
| Tolyltriazole | 0.1 | 0.1 | 0.1 | 0.1 | 0.1 |
| Polydimethylsiloxane | 0.02 | 0.02 | 0.02 | 0.02 | 0.02 |

The physicochemical characteristics of the compositions thus prepared are summarized in table 3 below.

TABLE 3

| Composition | I1 | C1 | C2 | C3 | C4 |
|---|---|---|---|---|---|
| Viscosity at 40° C. ($mm^2/s$)(1) | 31.94 | 31.95 | 35.80 | 31.61 | 35.81 |
| VI(2) | 131 | 131 | 131 | 131 | 130 |

(1)Kinematic viscosity measured at 40° C. according to standard ISO 3104

(2)Viscosity index measured according to standard ASTM D2270-93.

Example 2

Evaluation of the Properties of Lubricating Compositions

The various properties of the lubricating compositions prepared according to example 1 were evaluated in accordance with the measurement protocols detailed above.

The results are assembled in table 4 below.

TABLE 4

| Composition | I1 | C1 | C2 | C3 | C4 |
|---|---|---|---|---|---|
| Corrosion resistance | no rust | no rust | no rust | no rust | no rust |
| RPVOT (min) | 2924 | 7.155 | 1956 | — | 1748 |
| Residual RPVOT (%) | 80 | 68 | — | 56 | 38 |
| Variation in KV40 standardized method (%) | 4.3 | 0.8 | — | 14.1 | 1.6 |
| Variation in KV40 non-standardized method (%) | 1.5 | — | 23.43 | — | — |
| Variation in mass on Mg (mg) | 0 | 0 | — | −0.2 | 0 |
| Variation in mass on Cd (mg) | 0 | 0 | — | −2.2 | 0 |
| Insolubles at 0.45 μm (mg/kg) | 20 | 48 | — | 50 | 20 |

From these examples it is apparent that the composition in accordance with the invention (composition I1) combines excellent properties in terms of oxidation resistance, heat stability and corrosion resistance, at high temperatures, in contrast to compositions not comprising a combination of the three antioxidants specifically considered according to the invention (C1, C2 and C4), and/or to compositions not conforming to a diphenylamine/phosphite ester ratio by mass of strictly greater than 1.0 (composition C3).

The invention claimed is:

1. A composition for lubricating a gas or steam turbine, comprising, based on a total weight of the composition:

from 70% to 99% by weight of at least one base oil;

from 0.2% to 0.5% by weight of at least one alkylphenyl-α-naphthylamine compound;

from 0.2% to 0.5% by weight of at least one dialkyldiphenylamine compound; and from 0.1% to 0.3% by weight of at least one triaryl phosphite ester chosen from compounds of formula (III-a):

(III-a)

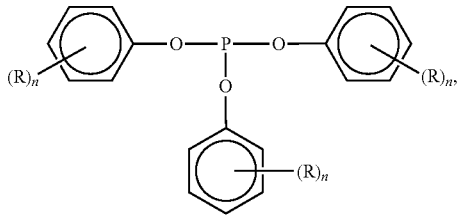

wherein:

each R is independently chosen from a linear or branched, $C_1$ to $C_{10}$ alkyl group; and each n is independently chosen from 1 or 2; and wherein the composition has a dialkyldiphenylamine compound to phosphite ester compound mass ratio of greater than 1.5, and wherein the composition comprises 200 ppm or less of phosphate ester anti-wear and/or extreme pressure additives.

2. The composition of claim 1, wherein the at least one dialkyldiphenylamine compound is chosen from compounds of formula (II):

(II)

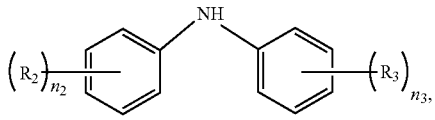

wherein:

$n_2$ and $n_3$ are independently chosen from 1, 2, 3, 4, or 5; and $R_2$ and $R_3$ are independently chosen from linear or branched alkyl groups.

3. The composition of claim 1, wherein the composition has a dialkyldiphenylamine compound to phosphite ester compound mass ratio ranging from 2.0 to 3.0.

4. The composition of claim 1, further comprising at least one additive chosen from antioxidants, viscosity index (VI) improvers, pour point depressants (PPD), antifoam agents, thickeners, corrosion inhibitors, copper passivators, or combinations of two or more thereof.

5. The composition of claim 1, wherein the composition has an alkylphenyl-α-naphthylamine compound to dialkyldiphenylamine compound mass ratio ranging from 0.8 to 1.0.

6. A method for lubricating a gas or steam turbine comprising applying to the gas or steam turbine a composition comprising, based on a total weight of the composition:

from 70% to 99% by weight of at least one base oil;

from 0.2% to 0.5% by weight of at least one alkylphenyl-α-naphthylamine compound;

from 0.2% to 0.5% by weight of at least one dialkyldiphenylamine compound; and from 0.1% to 0.3% by weight of at least one phosphite ester chosen from compounds of formula (III-a):

(III-a)

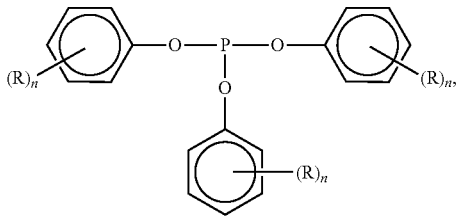

wherein:

each R is independently chosen from a linear or branched, $C_1$ to $C_{10}$ alkyl group; and each n is independently chosen from 1 or 2; and wherein the composition has a dialkyldiphenylamine compound to phosphite ester compound mass ratio of greater than 1.5, and wherein the composition comprises 200 ppm or less of phosphate ester anti-wear and/or extreme pressure additives.

7. The method of claim 6, wherein the composition has a dialkyldiphenylamine compound to phosphite ester compound mass ratio ranging from 2.0 to 3.0.

8. The method of claim 6, wherein the composition has an alkylphenyl-α-naphthylamine compound to dialkyldiphenylamine compound mass ratio ranging from 0.8 to 1.0.

* * * * *